US005766100A

United States Patent [19]

Dilmore

[11] Patent Number: 5,766,100

[45] Date of Patent: Jun. 16, 1998

[54] GOLF TEE APPARATUS

[76] Inventor: Clayton D. Dilmore, 8325 Capps Ave., Northridge, Calif. 91324

[21] Appl. No.: 919,405

[22] Filed: Aug. 28, 1997

[51] Int. Cl.[6] ..... A63B 57/00

[52] U.S. Cl. ..... 473/396; 473/398

[58] Field of Search ..... 473/387, 388, 473/389, 390, 391, 392, 393, 394, 395, 396, 397, 398, 400, 401, 402, 403, 405

[56] References Cited

U.S. PATENT DOCUMENTS

| | | | |
|---|---|---|---|
| 1,616,059 | 2/1927 | Mulvehill | 473/398 |
| 1,803,907 | 5/1931 | Kruse | 473/398 |
| 2,079,387 | 5/1937 | Sickmiller | 473/398 |
| 3,516,664 | 6/1970 | Brennan | 473/402 |
| 4,516,780 | 5/1985 | Tabet | 473/398 |
| 5,156,403 | 10/1992 | Martino | 473/396 |
| 5,356,146 | 10/1994 | Blosser | 473/400 |

*Primary Examiner*—Steven B. Wong
*Attorney, Agent, or Firm*—Jack C. Munro

[57] ABSTRACT

A golf tee apparatus designed primarily to be mounted in conjunction with a mat used at a driving range for driving of golf balls. The mat includes a hole within which is to be mounted a tube of a main support member. An insert is to be locatable within the tube. The insert has a through opening and a conventional golf tee which has a pointed lower end and a golf ball resting cup at the upper end is mounted in conjunction with the through opening with the pointed lower end being mounted within the through opening. The insert is snugly retained within the tube and the golf tee is snugly retained within the insert. A ball is to be placed on the golf ball resting cup of the golf tee with the golf ball to be struck by a golf club.

16 Claims, 3 Drawing Sheets

GOLF TEE APPARATUS

BACKGROUND OF THE INVENTION

1.) Field of the Invention

The field of this invention relates to sporting equipment and more particularly to a teeing apparatus for a golf ball.

2.) Description of the Prior Art

Golf tees are commonly used on golf courses and also on driving ranges. Within driving ranges, it is common to use a mat on which is located the golfer to drive the golf balls with golf clubs. The mat normally is designed to resemble a grass area with the exception that the mat is constructed to be far more durable than a conventional grass area. It is common to use a rubber tubular member that is mounted in conjunction with a hole formed within the mat. The rubber tubular member is mounted on an annular flange with this annular flange abutting against the bottom surface of the mat. The tube extends completely through the hole in the mat and protrudes some distance above the upper surface of the mat. The golf ball is to be placed on the rubber tube and it is to be struck off that tube thereby forming a golf tee for the golf ball.

This conventional form of a golf tee for a mat on a driving range has certain disadvantages. One of the disadvantages is that it is not adjustable in height. Some golfers like to tee the golf ball one inch to two inches above the surface of the mat while other players prefer to tee it up only one-quarter to one-half an inch off the surface of the mat. Also, some players like to angle the golf tee relative to the ground with this angle generally being in a forward direction. The golfer feels that by doing so, added distance is achievable when striking of the golf ball. Using of the prior art type of golf tee for a mat, there is no way to angle that tee. Also, using the conventional type of golf tee in conjunction with a mat does not offer the same resistance to the golfer as if the golfer was hitting from a conventional wooden golf tee on a golf course. The conventional wooden golf tee is pointed at one end and the opposite end has a golf ball resting cup. Additionally, the conventional tee for a mat is constantly being struck by the golf club when striking of the golf ball. Generally, in not too long a period of time, that golf tee becomes broken or deteriorated to the point that it requires replacement.

SUMMARY OF THE INVENTION

A golf tee apparatus which is constructed of an elongated tubular member. The tubular member has an internal cavity, normally this internal cavity being open at the upper end and the lower end. Within the first embodiment of this invention, the tube is integrally attached to an annular flange at the lower end. The tube is to be locatable within an opening formed within a mat which is normally used in conjunction with a golf driving range. The upper end of the tube protrudes above the upper surface of the mat. The material of construction for the tube and its connected flange would normally be comprised of a hard material such as a plastic. Mounted within the internal cavity is an insert which is normally constructed of a resilient material such as a soft rubber. The insert has a bulbous section which is snugly mounted within the internal cavity. However, the insert is to be adjustable longitudinally within the internal cavity and also may be turned to assume an angular position relative to the internal cavity. The insert includes a through opening. Mounted within the through opening in a snug fitting manner is a conventional (usually wooden) golf tee which has a pointed lower end and an upper end formed into a cup-shaped configuration for supporting a golf ball. The conventional golf tee is adjustable within the through opening so that the ball resting cup of the conventional golf tee can be adjustable to different heights in relation to the upper surface of the mat. In a second embodiment of golf tee apparatus of this invention, the upper surface of the tube is integrally connected to an annular flange. Mounted within the internal cavity is the insert which is snugly locked in position with this insert being constructed of the same material as the tube. This insert includes a longitudinal through opening and the pointed end of a conventional golf tee is inserted within that through opening and is snugly retained therein. The conventional golf tee will normally include a series of lines that can be used as a reference point to denote to the user the placement within the golf tee apparatus thereby facilitating to the golfer the precise locating of the ball resting cup relative to the upper surface of the mat so that each golf ball that is struck can be set at the same position.

The primary objective of the present invention is to construct a golf tee apparatus which presents to the golfer the same resistance as if the golfer were hitting from a conventional golf tee on a golf course even when using the conventional golf tee in conjunction with a mat on a driving range.

Another objective of the present invention is to construct a golf tee apparatus that most often retains the conventional golf tee in position and prevents the tee from breaking when being struck by the golf club and also keeps the conventional golf tee connected to the golf tee apparatus even after being struck by the golf club.

Another objective of the present invention is to construct a golf tee apparatus which incorporates height markings to be used by the golfer as a visual aide for ball height adjustment prior to striking of the golf ball.

Another objective of the present invention is to construct a golf tee apparatus which permits adjustment of the location of the golf ball from a low position directly adjacent the upper surface of the mat to a position spaced one to two inches above the surface of the mat according to the individual preference of the golfer.

DETAILED DESCRIPTION OF THE PREFERRED EMBODIMENTS

Figure 1:
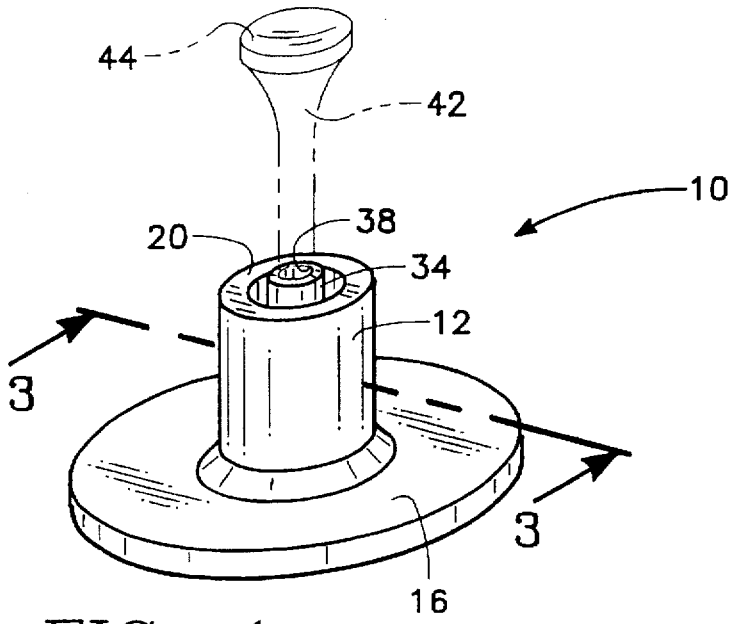
FIG. 1 is an isometric view of the first embodiment of golf tee apparatus of this invention showing the golf tee apparatus in its position of intended usage.
Figure 2:
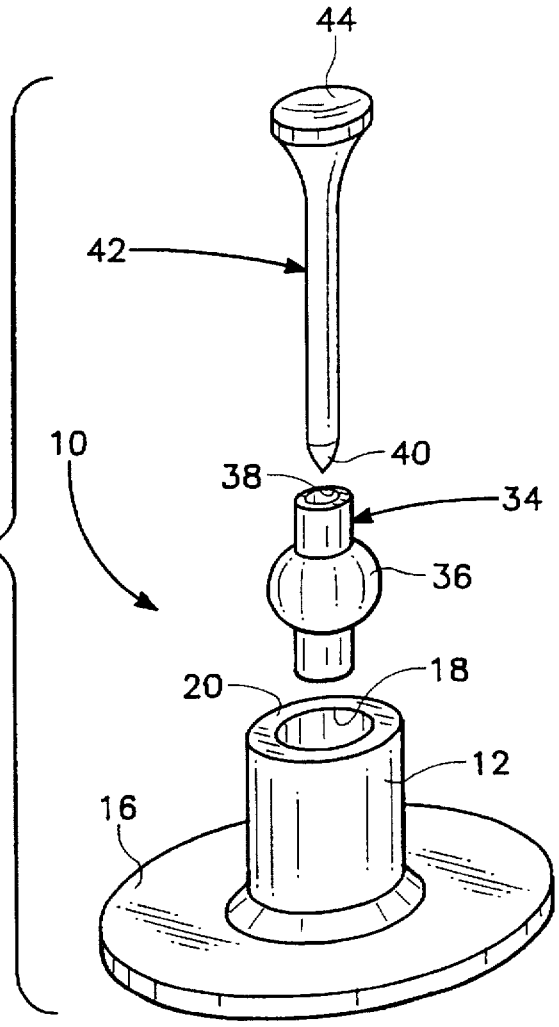
FIG. 2 is an exploded isometric view of the golf tee apparatus of FIG. 1.
Figure 3:
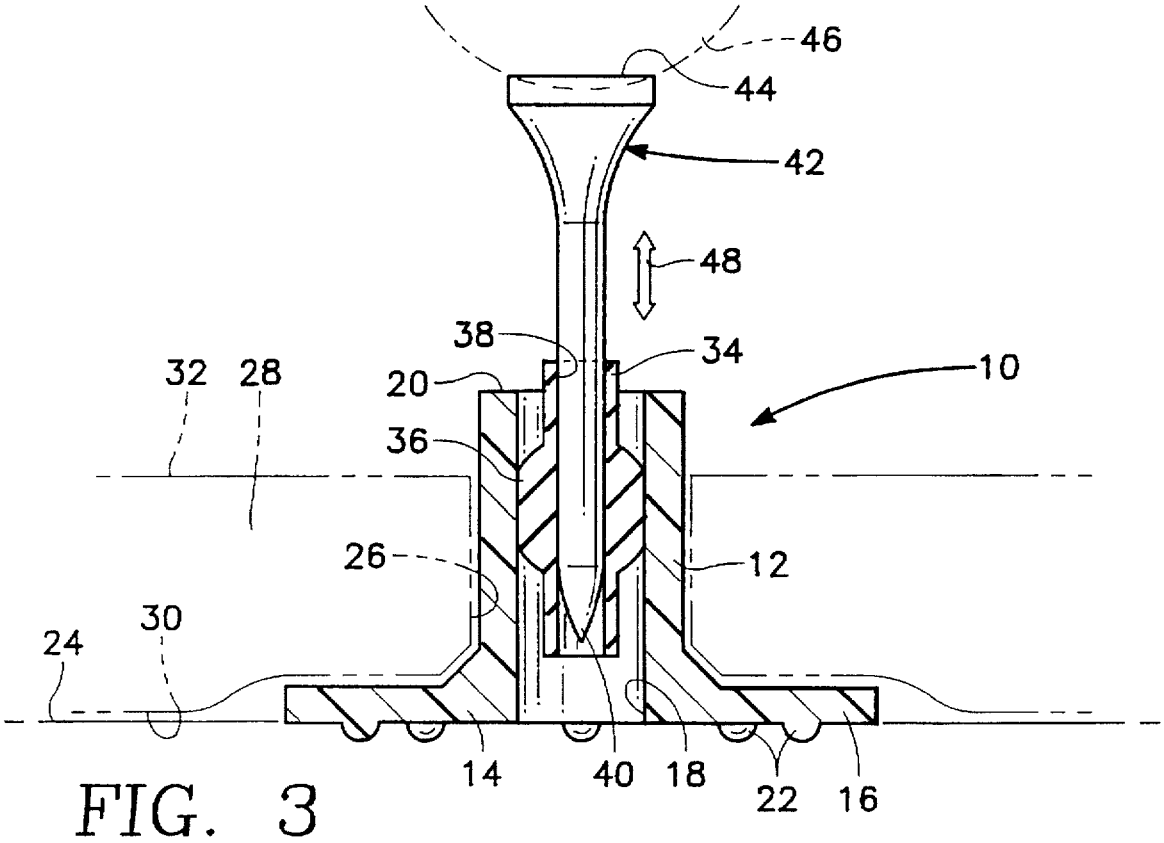
FIG. 3 is a cross-sectional view of the first embodiment taken along line 3—3 of FIG. 1 showing a conventional golf tee being connected with the golf tee apparatus in a directly vertical mounting arrangement.

Referring particularly to FIGS. 1–4 of the drawings, there is shown the first embodiment 10 of golf tee apparatus of this invention. The first embodiment includes a main support member in the form of a tube 12. The tube 12 would normally be constructed of a hard plastic material. The tube 12 has a lower end 14 which is integrally connected to an annular flange 16. The annular flange 16 is thin, generally no more than approximately one-eight to one-quarter inch thick, and annular flange 16 is two to three times the diameter of the tube 12. The tube 12 is shown to be cylindrical. However, it is considered within the scope of this invention that other configurations of tube 12 could be utilized such as to be hexagonal-shaped in cross section.

Tube 12 includes an internal cavity 18 which is open at the lower end 14 and also open at the upper end 20 of the tube 12. A typical diameter for the internal cavity 18 would generally be approximately one-half inch. The lower surface of the annular flange 16 may optionally include a series of protuberances 22. It would be the function of the protuberances 22 to form a functionally grabbing contact surface for the supporting surface 24 on which it is located. Typically, the surface 24 would normally be cement. Typically, the tube 12 is to be located within a hole 26 formed within a mat 28. The mat 28 has a bottom surface 30 and a top surface 32. The annular flange 16 is to be in contact with the bottom surface 30. The length of the tube 12 is such that it extends slightly exteriorly of the hole 26 with the upper end 20 being spaced slightly generally no more than about one-quarter inch above the top surface 32. The mat 28 would typically be constructed of some kind of synthetic material in order to resemble grass. The mat 28 is deemed to be conventional and is commonly used in driving ranges. Typically, such mats 28 are about an inch thick.

Mounted within the internal cavity 18 in a snug fitting manner is an insert 34. The insert 34 basically takes a configuration of a tube which has an exterior bulbous section 36. The material of construction of the insert 34 is substantially softer than the material of construction of the tube 12. Typically, the material of construction for the insert 34 will comprise a soft rubber. Therefore, when the insert 34 is located within the internal cavity 18, the bulbous section 36 will slightly deform as is clearly shown in FIGS. 3 and 4 of the drawings. The bulbous section 36 functions to snugly retain in the established position the insert 34 within the internal cavity 18. It is to be understood that the insert 34 can be adjusted to any desired position within the internal cavity 18, both longitudinally within the limits provided by supporting surface 24 and the length of the internal cavity 18. Also, the insert 34 can be canted to different angles such as shown in FIG. 4, the purpose of which will be explained further on in the Specification.

The insert 34 includes a through opening 38. The pointed end 40 of a conventional golf tee 42 is to be snugly located within the through opening 38. The upper end of the conventional golf tee 42 is formed into a ball resting cup 44. The conventional golf ball 46 is to be locatable and supported on the ball resting cup 44. It is the intention to propel or drive the conventional golf ball 46 off of the conventional golf tee 42 by a golf club which is not shown.

The conventional golf tee 42 can be mounted within the through opening 38 and the insert 34 moved within the internal cavity 18 until the pointed end 40 comes into contact with the supporting surface 24. This would be the lowermost position of the convention golf tee 42. However, the conventional golf tee 42 can be adjusted in the direction of arrow 48 within the through opening 38 and also the insert 34 can be adjusted within the internal cavity 18 which will result in the ball resting cup 44 occupying a space distance above the top surface 32. In this manner, the ball resting cup 44 can be located a substantial distance, such as one and one-half to two inches, above the top surface 32. Some golfers prefer to have the golf ball 46 to be teed up a substantial distance off the top surface 32 while other golfers prefer the golf ball 46 to be teed up very near the top surface 32. Therefore, the golfer can select his own particular preference for the teeing up height by using the golf tee of the first embodiment 10 of this invention.

Figure 4:
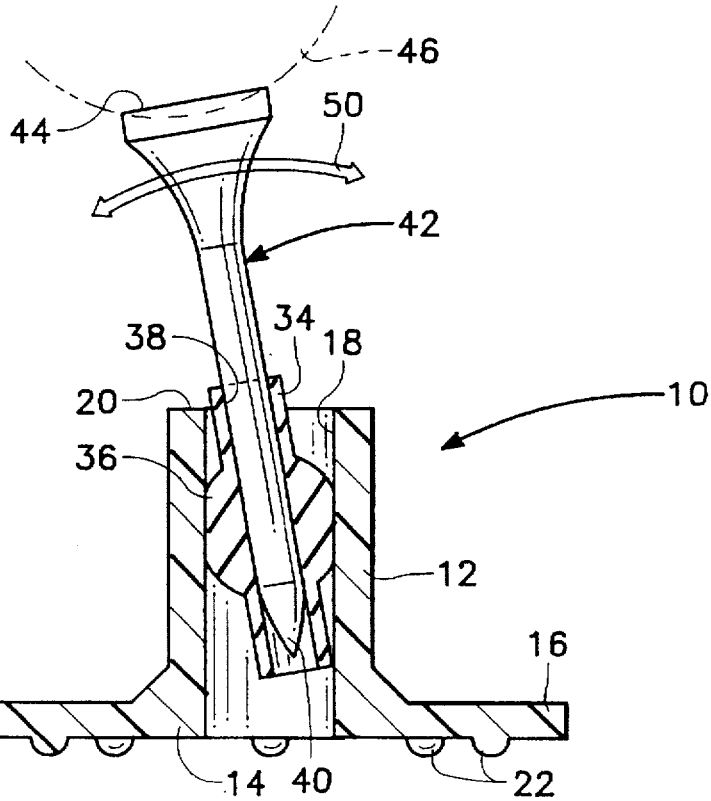
FIG. 4 is a cross-sectional view similar to FIG. 3 but showing the conventional golf tee located at an inclined position.

Referring particularly to FIG. 4, the conventional golf tee 42 can be moved to a canted position which is permitted by canting of the insert 34 within the internal cavity 18. This canting is in either a forward or rearward direction as depicted by arrow 50.

Figure 5:
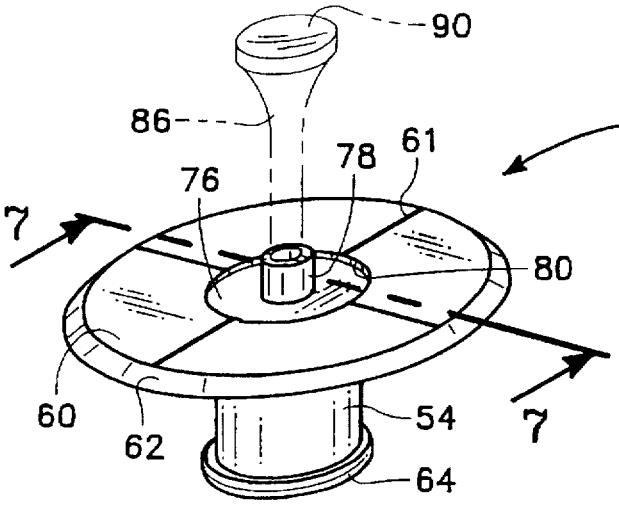
FIG. 5 is an isometric view of the second embodiment of the golf tee apparatus of this invention showing it in the position of intended usage.
Figure 7:
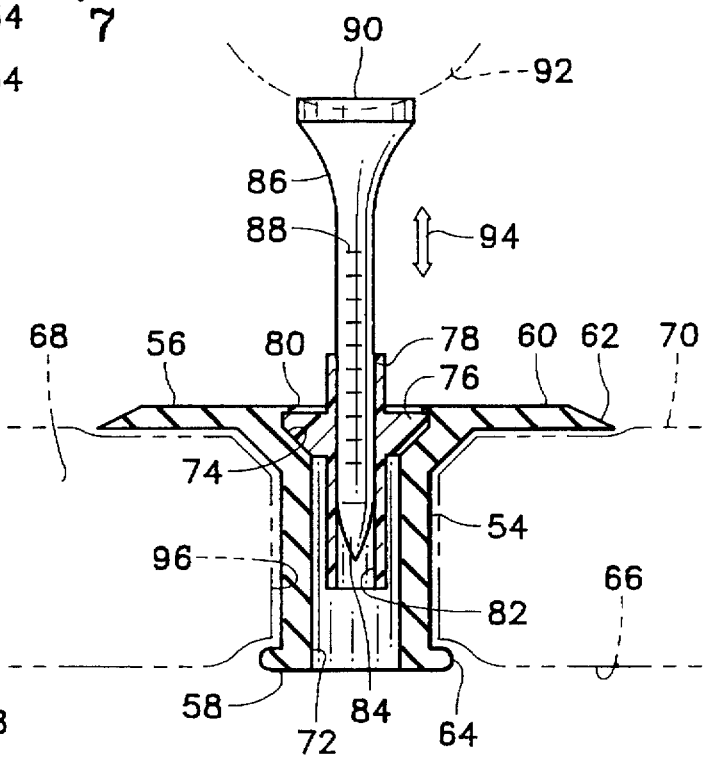
FIG. 7 is a cross-sectional view of the second embodiment of golf tee apparatus of this invention taken along line 7—7 of FIG. 5.
Figure 6:
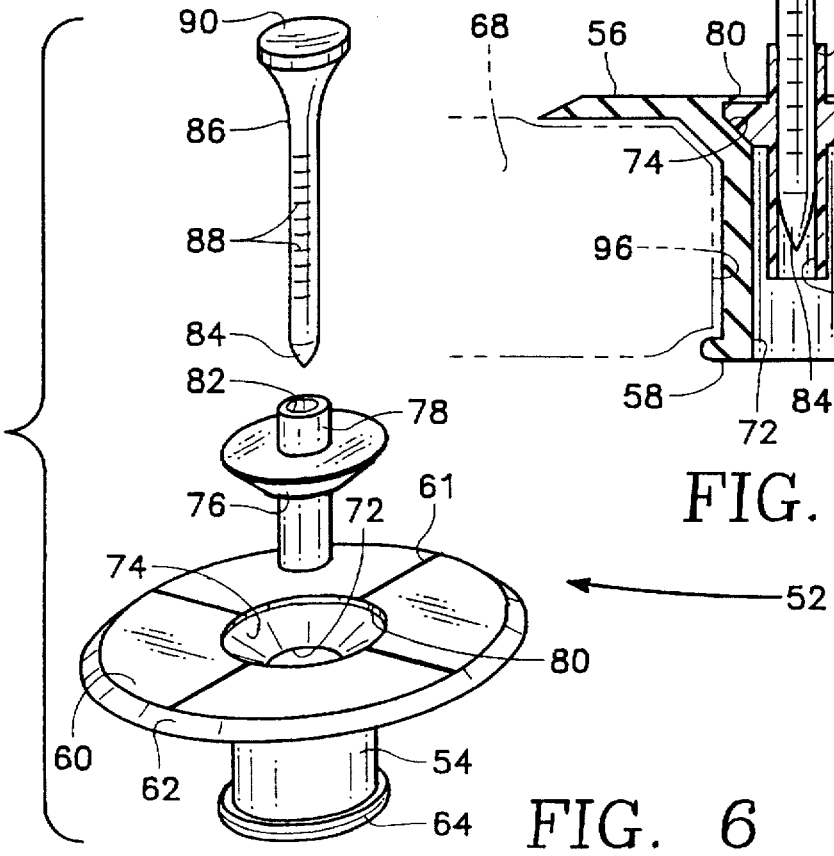
FIG. 6 is an exploded isometric view of the second embodiment of the second embodiment of golf tee apparatus of this invention.

Referring particularly to FIGS. 5–7 of the drawings, there is shown the second embodiment 52 of the second embodiment of golf tee apparatus of this invention. The second embodiment 52 includes a main support member in the form of a tube 54 which has an upper end 56 and a lower end 58. Integrally connected at the upper end 56 is an annular flange 60 which is basically similar to the previously discussed annular flange 16. Annular flange 60, however, does include a chamfered peripheral edge 62. However, the only reason for the chamfering of peripheral edge 62 is to decrease the possibility of direct impact with the golf club when swinging toward the golf ball 46.

The lower end 58 has exteriorly formed thereon an annular bead 64. The annular bead 64 is to be located against the bottom surface 66 of the mat 68. The annular flange 60 is to be located against the top surface 70 of the mat 68. A typical material of construction for the tube 54, annular flange 60 and annular bead 64 would normally comprise a hard plastic.

The tube 54 includes an internal cavity 72. The internal cavity 72 is open at the lower end 58 and also open at the upper end 56. However, at the upper end 56, the internal cavity 72 is formed into a conical seat 74. The conical seat 74 is to matingly engage with a conical flange 76 of an insert 78. Typically, the material of construction for the insert 78 will be essentially identical to the material of construction of the tube 54. The insert 78 is to be snapped into position past the ring-shaped locking bead 80 which defines the access opening into the conical seat 74. The insert 78 is thereby lockingly held in conjunction with the internal cavity 72 in a fixed position.

The annular flange is basically planer and includes an inscribed series of lines 61. There are four in number of the lines 61, equiangularly spaced apart, relative to internal cavity 72, so there are two horizontal lines (9 o'clock and 3 o'clock) and two vertical lines (12 o'clock and 6 o'clock). The lines 61 can be printed on annular flange 60 or could be formed as grooves on annular flange 60. Two of these lines, which are in alignment with each other, can be oriented in a particular direction which is to give guidance to the golfer as to the direction of the path of movement of the golf club across and over the annular flange 60. This is to help the golfer prevent slicing or hooking of the golf ball.

The insert 78 includes a through opening 82. Snugly mounted in conjunction with the through opening 82 is the pointed end 84 of a conventional golf tee 86. The conventional golf tee 86 may include a series of lined indicia 88 which is to help to define the height position of the conventional golf tee 86 relative to the top surface 70. The upper end of the conventional golf tee 86 terminates in a ball resting cup 90 within which is to be supportingly located a golf ball 92. Again, the conventional golf tee 86 is to be adjusted from a height point-of-view within the through opening 82 in the direction of arrow 94.

The tube 54 of the second embodiment 52 is to be forced through the hole 96 formed in the mat 68. In this particular position, the annular flange 60 is to abut against the top surface 70 with the annular bead 64 abutting against the bottom surface 66. Within the second embodiment 52, it is to be noted that it is not possible to cant the conventional golf tee 86 to various angles as can be accomplished within the first embodiment 10 of this invention.

What is claimed is:

1. A golf tee apparatus comprising:

a main support member, said main support member including a tube, said tube having an upper end and a lower end, said tube having an internal cavity, an access opening providing access into said internal cavity;

an insert located within said internal cavity and extending exteriorly of said access opening, said insert having an interior opening, said insert being fixable in position within said internal cavity, said insert having an exteriorly extending bulbous section, said bulbous section to be in contact with said internal cavity of said tube; and whereby a conventional golf tee which has one end pointed and the opposite end including a ball resting cup, is inserted by the pointed end into said interior opening and is snugly held in position thereby permitting striking by a golf club of a golf ball resting on the resting cup.

2. The golf tee apparatus as defined in claim 1 wherein:

said main support member having an annular flange extending outwardly from said tube.

3. The golf tee apparatus as defined in claim 2 wherein:

said annular flange being located at said lower end of said tube.

4. The golf tee apparatus as defined in claim 1 wherein:

said internal cavity being cylindrical.

5. The golf tee apparatus as defined in claim 1 wherein:

said internal cavity constituting a through opening.

6. The golf tee apparatus as defined in claim 1 wherein:

said insert being snugly located within said internal cavity.

7. The golf tee apparatus as defined in claim 1 wherein:

said insert being adjustable along the length of said internal cavity.

8. The golf tee apparatus as defined in claim 1 wherein:

said insert being adjustably movable to various angular positions relative to said tube.

9. The golf tee apparatus as defined in claim 1 wherein:

said insert being formed of a resilient material which is substantially softer than the material of construction of said main support member, said insert being easily deformable.

10. The golf tee apparatus as defined in claim 1 wherein:

said golf tee apparatus being mounted in conjunction with a mat.

11. The golf tee apparatus comprising:

a main support member, said main support member including a tube, said tube having an upper end and a lower end, said tube having an internal cavity, an access opening providing access into said internal cavity, said access opening forming a conically-shaped recess;

an insert located within said internal cavity and extending exteriorly of said access opening, said insert having a conical flange, said conical flange fixedly engaging with said conical recess; and whereby a conventional golf tee, which has one end pointed and the opposite end including a ball resting cup, is inserted by the pointed end into said interior opening and is snugly held in position thereby permitting striking by a golf club of a golf ball resting on the resting cup.

12. The golf tee apparatus as defined in claim 11 wherein:

said main support member having an annular flange extending outwardly from said tube, said annular flange being located at said upper end of said tube.

13. The golf tee apparatus as defined in claim 12 wherein:

a series of lines inscribed on said annular flange, said series of lines to assist the golfer in giving proper direction of movement of the swing of the golf club.

14. The golf tee apparatus as defined in claim 13 wherein:

said series of lines comprising four in number equiangularly spaced apart about said tube, two of said lines being in alignment with the remaining two of said lines being in alignment.

15. The golf tee apparatus as defined in claim 12 wherein:

said tube having an annular bead, said annular bead being located at said lower end of said tube.

16. The golf tee apparatus as defined in claim 11 wherein:

said golf tee apparatus being mounted in conjunction with a mat.

* * * * *